US010274898B2

(12) United States Patent
Leyden et al.

(10) Patent No.: US 10,274,898 B2
(45) Date of Patent: Apr. 30, 2019

(54) SECURITY SYSTEM FOR WRIST WATCHES

(71) Applicant: SE-KURE CONTROLS, INC., Franklin Park, IL (US)

(72) Inventors: Roger J. Leyden, Inverness, IL (US); David M. Adams, Stone Park, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 313 days.

(21) Appl. No.: 15/338,850

(22) Filed: Oct. 31, 2016

(65) Prior Publication Data

US 2017/0131685 A1 May 11, 2017

Related U.S. Application Data

(60) Provisional application No. 62/254,000, filed on Nov. 11, 2015.

(51) Int. Cl.

| | |
|---|---|
| ***G04B 47/06*** | (2006.01) |
| ***G04B 37/14*** | (2006.01) |
| ***G04D 99/00*** | (2006.01) |

(52) U.S. Cl.

CPC ..... *G04B 47/06* (2013.01); *G04B 37/14* (2013.01); *G04B 37/1486* (2013.01); *G04D 99/00* (2013.01)

(58) Field of Classification Search

CPC .. A61B 5/00; A61B 5/002; A61B 5/01; A61B 5/02; A61B 5/1126; A61B 5/1135; A61B 5/6833; A41D 1/00; A41D 1/005; G04B 37/14; G04B 37/1486

See application file for complete search history.

(56) References Cited

U.S. PATENT DOCUMENTS

| | | | | |
|---|---|---|---|---|
| 5,782,790 | A * | 7/1998 | Allen | A61F 5/0102 2/69 |
| 2015/0351688 | A1* | 12/2015 | Just | A61B 5/681 600/407 |
| 2016/0206215 | A1* | 7/2016 | Takahashi | A61B 5/681 |
| 2017/0035329 | A1* | 2/2017 | Gavish | A61B 5/1126 |
| 2018/0199635 | A1* | 7/2018 | Longinotti-Buitoni | A41D 1/005 |

* cited by examiner

*Primary Examiner* — Van T Trieu

(74) *Attorney, Agent, or Firm* — Wood, Phillips, Katz, Clark & Mortimer

(57) ABSTRACT

The combination of a wearable device and a security assembly. The wearable device has a band configured to extend at least partially around a limb of a user to maintain the wearable device operatively supported on the user's limb. The security assembly has a flexible sensor configured to define an electrical circuit path. The flexible sensor is secured to the band in an operative state. A stabilizing assembly is configured to bear a part of the flexible sensor against the wearable device with the stabilizing assembly in an operative state.

24 Claims, 4 Drawing Sheets

SECURITY SYSTEM FOR WRIST WATCHES

BACKGROUND OF THE INVENTION

Field of the Invention

This invention relates to security systems and, more particularly, to a security system used to prevent theft of wrist worn devices, such as watches, at point-of-purchase displays.

Background Art

Wrist watches are currently available in a multitude of different types and styles and over a wide price range. As options for purchase increase, so does the need to make wrist watches available for a meaningful inspection by potential purchasers. Such an inspection usually involves the investigation and testing of features and the consideration of appearance with the wrist watch being worn.

Heretofore, watches have generally been displayed in one of two different manners. Lower price range watches are routinely displayed in individual boxes which are either see-through or openable to allow inspection.

Higher priced watches are usually displayed in an unboxed state in glass cases that are locked and overseen by sales personnel.

Boxed watches generally take up a good bit of usable shelf space and introduce a significant level of inconvenience, particularly when inspection and wearing of the watches are undertaken. Typically, the boxes are custom fit to a particular watch which must be carefully placed therein to most effectively display the same. Once a watch is removed from the box to be worn by a potential purchaser, it may be replaced without much care being taken so that it does not show well within the box to the next observer.

The manning of glass displays, aside from the fact that it necessitates more personnel, offers a serious challenge to sales people, particularly when there is a large number of potential customers wishing to inspect watches at the same time. It is common for a single customer to want to inspect and wear a significant number of watches during a visit. It may be difficult for a sales person to keep track of all of the watches as they are serially removed and often left in potentially significant numbers on a countertop. Would-be thieves can add to the confusion by purposely placing unusual demands on sales personnel which may ultimately result in a loss of inventory.

The deficiencies with the above two types of watch display methods led to the evolution of individual security systems for wrist watches. One such type of security system uses a dedicated stand for each watch. A tether, with a fixed electronic sensor, is secured to the watch on the stand. This tether system has been successful but has the primary drawback that it is commonly defeated by thieves that are able to separate the tether end from the stand and watch without triggering an alarm. When it is projected that thefts will continue and reach a certain level using this type of security system, the investment therein may not be justified.

It is also known to use flexible sensors in electronic security systems for watches. The flexible sensor is attached to the watch band and creates a circuit that is interrupted in the event that the sensor is removed from the watch band or is compromised, as by being worn repeatedly or unintentionally torn. Either condition generates an alarm.

While the latter system has been generally effective, it has the primary drawback that the sensor is prone to being compromised through an ongoing intended normal use. The sensor is typically applied in the inside of the watch band and is constructed to flex with the watch band as it is wrapped around a wearer's wrist. Repetitive bending of the band and wearing of the watch may lead to a progressive deterioration of the sensor and/or unintended separation of the sensor from the watch band. Alternatively, the relatively thin sensor is prone to tearing as it is reconfigured to be placed against and separated from a wearer's wrist region. This problem is aggravated by the fact that any tether attached to the sensor may exert significant concentrated tearing and separation forces on the sensor as the secured watch is manipulated by store personnel and potential purchasers at a point-of-purchase display.

As the watch industry continues to grow, there becomes an increasing need to offer to merchants a security system that is affordable, yet reliable enough to warrant significant investment to protect watches in a wide price range.

SUMMARY OF THE INVENTION

The invention is directed to the combination of a wearable device and a security assembly. The wearable device has a band configured to extend at least partially around a limb of a user to maintain the wearable device operatively supported on the user's limb. The security assembly has a flexible sensor configured to define an electrical circuit path. The flexible sensor is secured to the band in an operative state. A stabilizing assembly is configured to bear a part of the flexible sensor against the wearable device with the stabilizing assembly in an operative state.

In one form, the flexible sensor is secured to the band through an adhesive layer.

In one form, the inventive combination is provided in further combination with a connecting assembly, a monitoring assembly, and an alarm signal generator. The connecting assembly is electrically connected between the flexible sensor and monitoring assembly. The flexible sensor, connecting assembly, monitoring assembly, and alarm signal generator are configured and electrically interconnected to cause the alarm signal generator to generate an alarm signal as an incident of at least one of: a) the flexible sensor being changed from its operative state; and b) the electrical circuit path being altered.

In one form, the connecting assembly is a flexible tether.

In one form, the stabilizing assembly defines a conductive path and makes up a part of the connecting assembly.

In one form, the wearable device is a watch with a case, for operating components, connected to the band.

In one form, the band has an inside surface that is configured to bear against a user's limb with the wearable device operatively supported on a user's limb. The flexible sensor in its operative state is secured against the inside band surface.

In one form, with the stabilizing assembly in its operative state, the stabilizing assembly bears a part of the flexible sensor against the inside band surface.

In one form, with the flexible sensor in its operative state a part of the flexible sensor is secured against the case.

In one form, the stabilizing assembly has first and second relatively movable parts. A part of each of the flexible sensor and band resides between the first and second parts of the stabilizing assembly with the stabilizing assembly in its operative state.

In one form, the first and second parts are connected at a hinge which guides relative movement between the first and second parts around an axis.

In one form, the first part defines a circuit that electrically connects to the electrical circuit path defined by the flexible sensor.

In one form, the second part defines a receptacle into which the part of the band is situated with the stabilizing assembly in its operative state.

In one form, the second part has a "U" shape bounding the receptacle. The "U" shape is defined by a base and spaced legs. With the stabilizing assembly in its operative state, the first part spans the first and second legs.

In one form, the stabilizing assembly further includes a resilient component that is compressed between the band and the base with the stabilizing assembly in its operative state.

In one form, the first part is movable relative to the second part between an open position and a closed position. The first part is in the closed position with the stabilizing assembly in its operative state. The stabilizing assembly, flexible sensor and band are configured so that the flexible sensor, band, and resilient component become captured under pressure between the first part and the base as an incident of the first part being moved from the open position into the closed position.

In one form, the stabilizing assembly further includes a fastener for releasably maintaining the first part in the closed position.

In one form, the resilient component is a compressible foam.

In one form, the fastener is a threaded fastener with a head with a security fitting configured so that a customized security tool must be utilized to engage and turn the head of the threaded fastener.

In one form, the invention is directed to a security assembly as described above.

DETAILED DESCRIPTION OF THE PREFERRED EMBODIMENT

Figure 1:
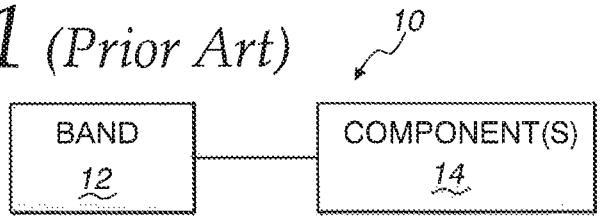
Fig. 1 (Prior Art)
FIG. 1 is a schematic representation of one type of conventional wearable device with which the present invention can be utilized.

In FIG. 1, a schematic depiction of a wearable device, with which the present invention is usable, is shown at 10. The wearable device 10 has a band 12 configured to extend at least partially around a wrist of a user to maintain the device operatively supported on the user's wrist.

The wearable device 10 may consist of nothing more than the band 12. The device 10 may alternatively have incorporated into the band 12 one or more additional components 14, that may be functional and/or ornamental in nature.

Figure 2:
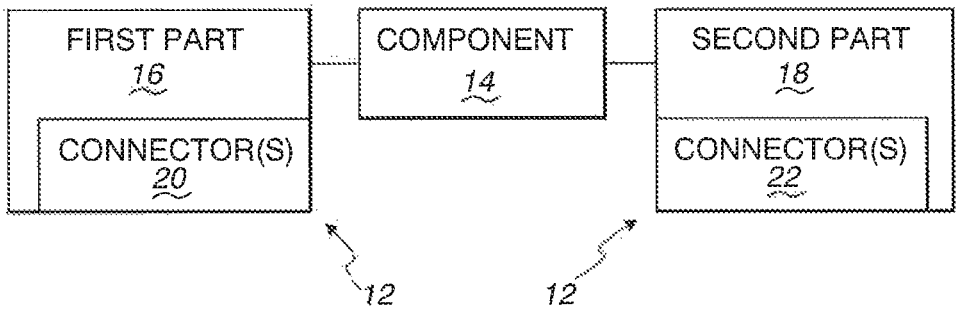
Fig. 2 (Prior Art)
FIG. 2 is a schematic representation of an alternative form of conventional wearable device with which the present invention can be utilized.

The band 12 can have many different configurations. In one form, with the exemplary component 14 in the form of a watch, the band 12, as shown in FIG. 2, may be made of first and second parts 16, 18, respectively, that are each connected to the component 14 and releasably joinable to each other, through one or more connectors 20, 22, respectively on the first and second parts 16, 18.

Alternatively, the band 12 may be formed, alone or in conjunction with a component 14, into a continuous shape that may be placed over a user's hand to surround his/her wrist. The band 12 may be expandable.

In a still further alternative form, the band 12 may have a shape that, by itself or in conjunction with the component 14, extends less than fully around a user's wrist.

The details of the band 14 are not critical to the present invention as virtually any configuration is contemplated and may be used with the present invention.

Figure 3:
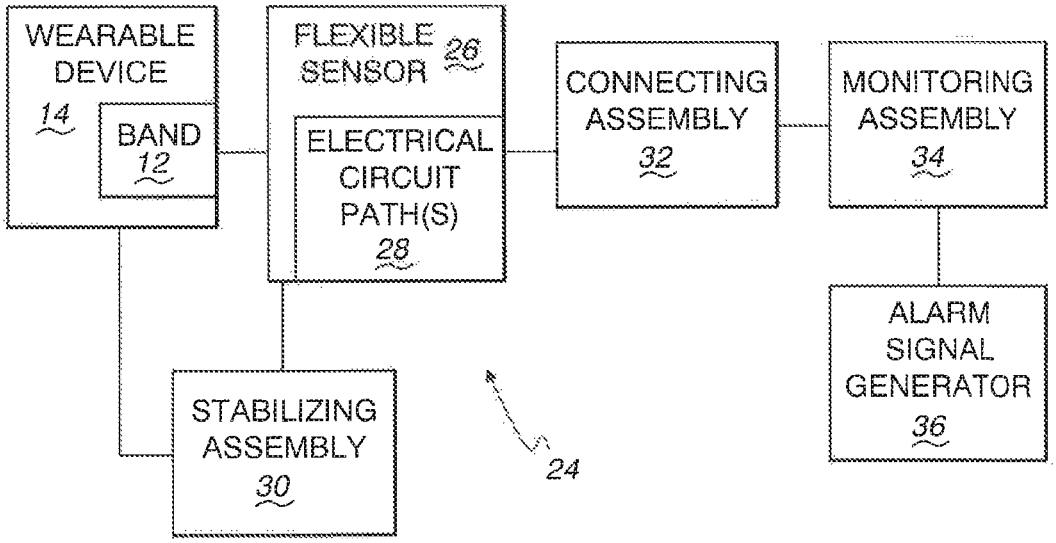
FIG. 3 is a schematic representation of a wearable device with a security assembly, according to the present invention, operatively engaged therewith and interacting with a connecting assembly, monitoring assembly, and alarm signal generator.

The invention is focused primarily upon a security assembly shown schematically at 24 in FIG. 3 as it is used in association with the wearable device 14. The security assembly 24 consists of a flexible sensor 26 that defines at least one electrical circuit path 28. The flexible sensor 26 is secured to at least the band 12 on the wearable device 14 with the flexible sensor 26 in an operative state.

The security assembly 24 further includes a stabilizing assembly at 30 that is configured to bear a part of the flexible sensor 26 against the wearable device 14 with the stabilizing assembly 30 in its operative state.

A connecting assembly 32 electrically connects the one or more circuit paths 28 to a monitoring assembly 34, that uses electrical processing equipment to detect at least one of: a) the flexible sensor 26 being changed from its operative state; and b) the electrical circuit path(s) 28 being altered. The monitoring assembly 34 is configured so that either of these detected conditions causes the monitoring assembly 34 to trigger an alarm signal generator 36 that produces some form of detectable signal that alerts a supervisor, on the site and/or remotely, that the securing system for the wearable device 14 has been breached.

The connecting assembly 32, monitoring assembly 34, and alarm signal generator 36 may be separate components, or alternatively integrated as a single component or multiple components that combine these components in different manners.

The components in FIGS. 1-3 have been shown schematically to encompass the specific forms thereof as described hereinbelow, and virtually an unlimited number of variations thereof and their interactions. The structural details of many of the components, such as the connecting assembly 32, monitoring assembly 34, and alarm signal generator 36, are not critical to the present invention and might be devised in many forms by those skilled in the art to perform the basic functions as described above. To the extent that any details of components and other interactions in FIGS. 1-3 are important, they have been described hereinbelow with respect to specific embodiments.

In FIGS. 4-8, the exemplary wearable device 10 is shown in the form of a watch, with the band 12 made up of the aforementioned first and second parts 16, 18 that are each joined to the component 14. The component 14 consists of a case 38 with various internal and external operating components 40 thereon and therewithin. The band parts 16, 18 have conventional connectors 20, 22, respectively, which are releasably engageable to define a continuous band configuration with a selectively variable effective diameter. In this embodiment, the band parts 16, 18 connect to the case 38 so that the diameter of the band includes the additional dimension defined by the case portion between the connected band parts 16, 18.

The flexible sensor 26 may have virtually an unlimited number of different configurations. One exemplary construction therefor is shown in U.S. Pat. No. 5,644,295, to Connolly et al., the disclosure of which is incorporated herein by reference. What is key to the design is that the flexible sensor can bend with the band 12 while maintaining intact the one or more electrical circuit paths 28. The precise size and shape of the flexible sensor 26 might be varied significantly from the exemplary form described herein.

The flexible sensor 26 has a body 42 defined by the multiple interacting electrical and mechanical component parts thereof. The body 42 has a generally flat shape with oppositely facing flat surfaces 44, 46. The surface 44 is secured to the case 38 and an inside surface 48 on the band 12, preferably utilizing an adhesive 50.

In this embodiment, the body 42 has an enlarged end 52 bonded to a flat case surface 54. The end 52 blends into an L-shaped portion 56 with a longer leg 58 and a shorter leg 60. The longer leg 58 is bonded to the inside band surface 48 along a substantial portion of the length of the band part 18. As depicted, the longer leg 58 extends over a majority of the length of the band part 18 in a substantially centered widthwise relationship with the flexible sensor 26 in its depicted operative state.

Figure 8:
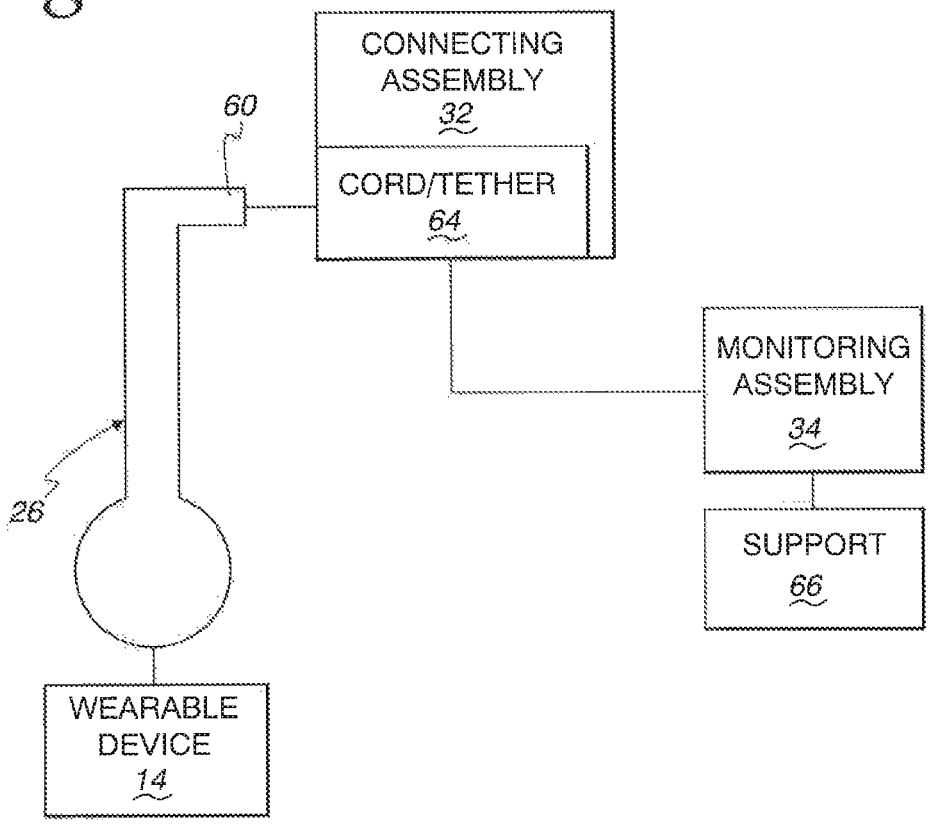
FIG. 8 is a schematic representation of a modified form of security assembly, according to the present invention, and interacting with the connecting assembly and monitoring assembly.

The shorter leg 60 projects from the longer leg 58 past one side edge 62 of the band part 18. As shown in FIG. 8, the shorter leg 60 on the flexible sensor 26 may be directly connected to a conductive cord 64 that makes up part or all of the connecting assembly and functions as a tether to mechanically confine movement of the wearable device 10 away from a fixed support 66 upon which the monitoring assembly 34 is provided.

Figure 7:
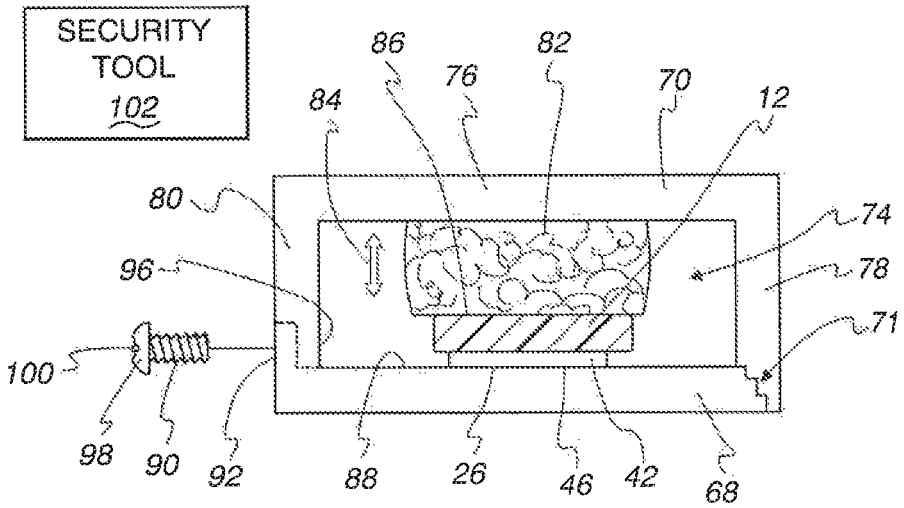
FIG. 7 is a plan view of the inventive security assembly, as shown in FIGS. 4 and 5, in its operative state with respect to the watch.

In the depicted form in FIGS. 4 and 5, the connecting assembly 32 is defined at least in part by the stabilizing assembly 30, as described in greater detail hereinbelow. In this embodiment, the stabilizing assembly performs both an electrical and a mechanical function; the former by bearing a part of the flexible sensor 26 against the band surface 48 with the stabilizing assembly 30 in its operative state as shown in FIG. 7.

The stabilizing assembly 30 consists of first and second relatively movable parts 68, 70, respectively. The first and second parts 68, 70 are connected at a hinge 71 which guides relative movement between the first and second parts 68, 70 around an axis 72.

The second part 70 has a generally "U" shape bounding a receptacle 74. The "U" shape is defined by a base 76 and spaced legs 78, 80.

A resilient component 82 is mounted against the base 76 within the receptacle 74. The resilient component 82 may be made from a compressible foam or other type of material that allows it to compress and expand readily under forces applied in the direction of the double-headed arrow 84 in FIG. 7.

Figure 4:
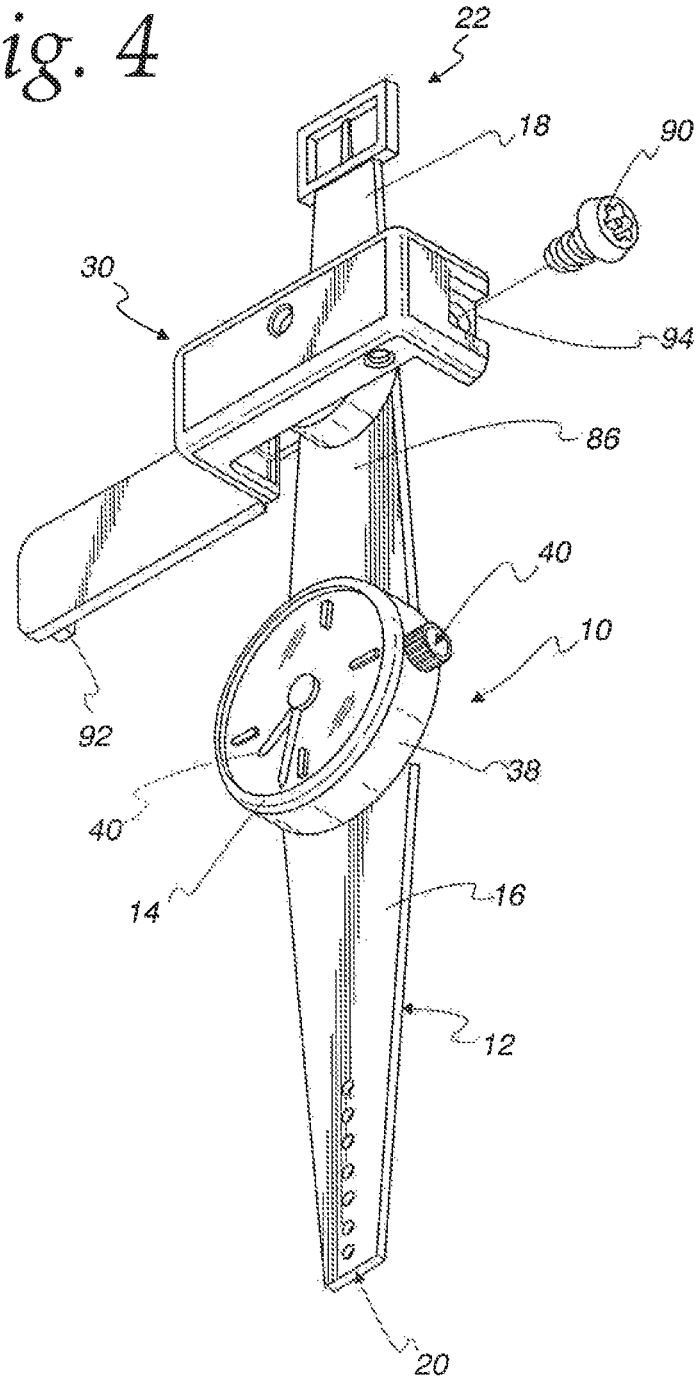
FIG. 4 is a perspective view of a representative wearable device, in the form of a watch, in relationship to one form of security assembly, according to the present invention and as shown schematically in FIG. 3.
Figures 5, 6:
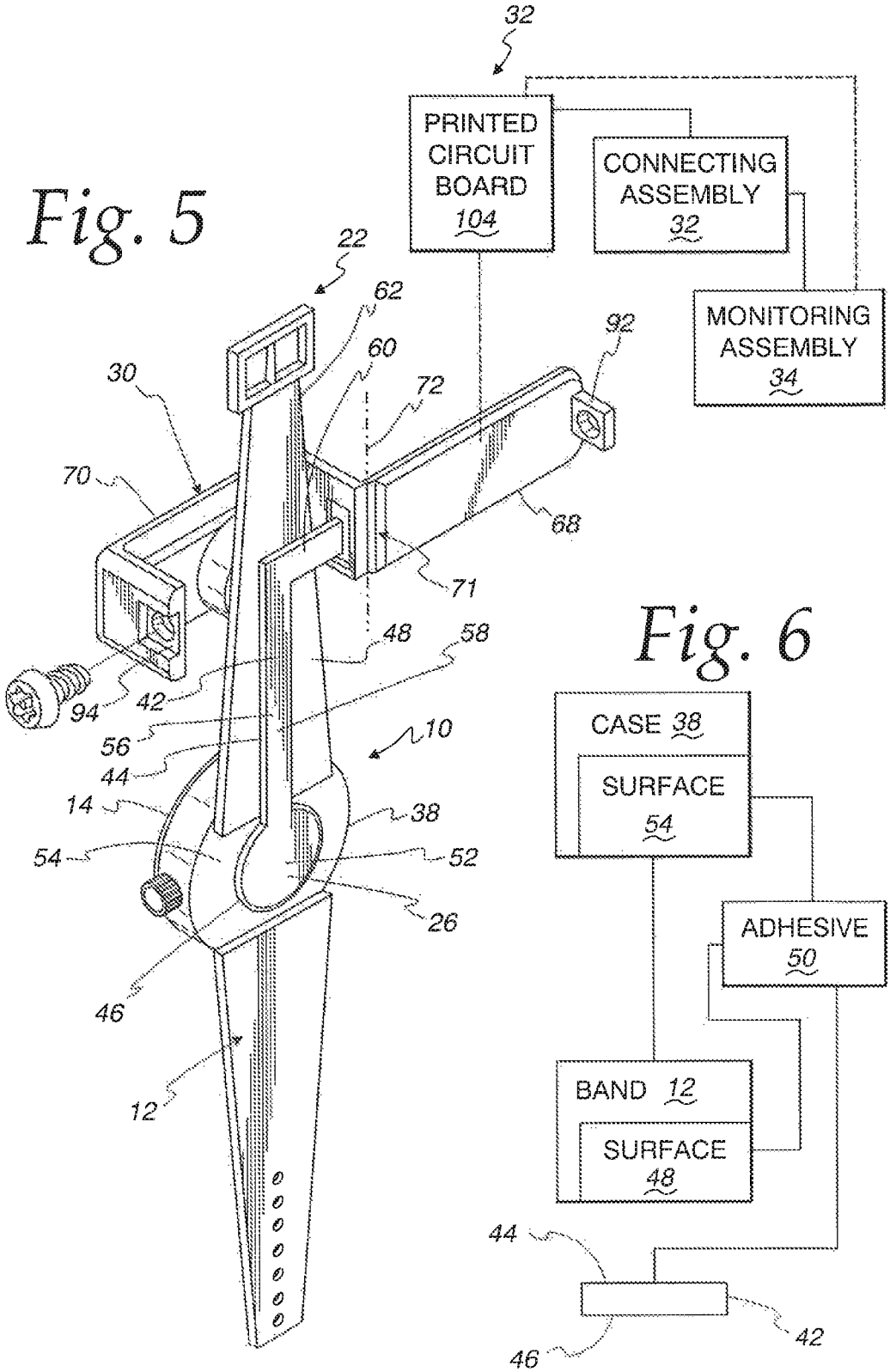
FIG. 5 is a view as in FIG. 4 from a different perspective.
FIG. 6 is a schematic representation of a flexible sensor, that makes up part of the inventive security assembly, that is operatively connected to a band and case on the watch.

The first part 68 of the stabilizing assembly 30 is movable relative to the second part 70 between an open position, as shown in FIGS. 4 and 5, and a closed position, as shown in FIG. 7. In its closed position, the first part 68 spans the first and second legs 78, 80 whereby the first and second parts 68, 70 cooperatively extend continuously around the receptacle 74.

To place the stabilizing assembly 30 in its operative state, the first part 68 is moved into its open position whereupon the outside surface 86 of the band part 18 is placed against the resilient component 82. By then moving the first part 68 from its open position into its closed position, a flat surface 88 on the first part 68 bears against the surface 46 of the body 42 of the flexible sensor 26. The parts 68, 70, resilient component 82, band 12, and flexible sensor 26 are dimensioned so that once the first part 68 realizes its closed position, the flexible sensor 26, band 12, and resilient component 82 become captured under pressure between the first part 68 and the base 76 on the second part 70. By reason of the resilient nature of the component 82, the pressure imparted thereby against the flexible sensor 26 is adequate to effect stabilization thereof without inflicting damage thereon. These forces resist any tendency of the flexible sensor 26 to separate from the band 12 as the wearable device 14 is manipulated by a person who might choose to extend the band 12 around his/her wrist and secure the same through the connectors 20, 22.

The closed position for the first part 68 is releasably maintained by a threaded fastener 90. The fastener 90 extends through: a) a tab 92 on the first part 68 that moves into a complementary recess 94 on a part 96 of the leg 80; and b) the undercut part 96 of the leg 80.

The fastener 90 preferably has a head 98 with a security fitting 100 configured so that a customized security tool 102, as seen in FIG. 7, must be utilized to engage and turn the head 98 of the fastener 90.

As an alternative construction to that shown in FIG. 8, the first part 68, as shown in FIGS. 4 and 5, defines a conductive path between the flexible sensor 26 and the monitoring assembly 34. The first part 68 thus makes up part or all of the connecting assembly 32. As depicted, the first part 68 incorporates a printed circuit board 104 that defines one or more electrical circuit paths directly to the monitoring assembly 34, as shown in dotted lines in FIG. 5, or through an intermediate portion of the connecting assembly as shown in solid lines. The intermediate connecting assembly portion 32 may be in the form of a flexible cable that also performs a mechanical tethering function.

With the depicted construction, a flexible sensor 26, connecting assembly 32, and monitoring assembly 34 are configured and electrically interconnected to cause the alarm signal generator 36 to generate an alarm signal as an incident of at least one of: a) the flexible sensor 26 being changed from its operative state; and b) the electrical circuit path defined by the flexible sensor 26 and/or the connecting assembly 32 being altered.

As noted above, the stabilizing assembly 30 helps to maintain the integrity of the flexible sensor 26 as the wearable device 14 is monitored, while at the same time allowing the wearable device 14 to be normally worn by a user with potentially only insignificant interference from the stabilizing assembly 30.

The wearable device, while described as a watch worn on a wrist, might be any type of device wrapped around any limb of a wearer, which may be other than a wrist.

The foregoing disclosure of specific embodiments is intended to be illustrative of the broad concepts comprehended by the invention.

The invention claimed is:

1. In combination:

a) a wearable device comprising a band configured to extend at least partially around a limb of a user to maintain the wearable device operatively supported on the user's limb; and b) a security assembly comprising:

a flexible sensor configured to define an electrical circuit path, the flexible sensor secured to the band in an operative state; and a stabilizing assembly that is configured to resiliently bear a part of the secured flexible sensor against the wearable device with the stabilizing assembly in an operative state.

2. The combination according to claim 1 wherein the flexible sensor is secured to the band through an adhesive layer.

3. The combination according to claim 1 further in combination with a connecting assembly, a monitoring assembly, and an alarm signal generator, the connecting assembly electrically connecting between the flexible sensor and monitoring assembly, the flexible sensor, connecting assembly, monitoring assembly, and alarm signal generator configured and electrically interconnected to cause the alarm signal generator to generate an alarm signal as an incident of at least one of: a) the flexible sensor being changed from its operative state; and b) the electrical circuit path being altered.

4. The combination according to claim 3 wherein the connecting assembly comprises a flexible tether.

5. The combination according to claim 3 wherein the stabilizing assembly defines a conductive path and makes up a part of the connecting assembly.

6. The combination according to claim 1 wherein the wearable device comprises a watch with a case for operating components connected to the band.

7. The combination according to claim 6 wherein with the flexible sensor in its operative state a part of the flexible sensor is secured against the case.

8. The combination according to claim 1 wherein the band has an inside surface configured to bear directly against a user's limb with the wearable device operatively supported on a user's limb and the flexible sensor in its operative state is secured against the inside band surface.

9. The combination according to claim 8 wherein with the stabilizing assembly in its operative state the stabilizing assembly bears a part of the flexible sensor against the inside band surface.

10. The combination according to claim 9 wherein the stabilizing assembly comprises first and second relatively movable parts and a part of each of the flexible sensor and band resides between the first and second parts of the stabilizing assembly with the stabilizing assembly in its operative state.

11. The combination according to claim 10 wherein the first and second parts are connected at a hinge which guides relative movement between the first and second parts around an axis.

12. The combination according to claim 11 wherein the first part defines a circuit that electrically connects to the electrical circuit path defined by the flexible sensor.

13. The combination according to claim 11 wherein the second part defines a receptacle in which the part of the band is situated with the stabilizing assembly in its operative state.

14. The combination according to claim 13 wherein the second part has a "U" shape bounding the receptacle, the "U" shape defined by a base and spaced legs and with the stabilizing assembly in its operative state the first part spans the first and second legs.

15. The combination according to claim 14 wherein the stabilizing assembly further comprises a resilient component that is compressed between the band and the base with the stabilizing assembly in its operative state.

16. The combination according to claim 15 wherein the first part is movable relative to the second part between an open position and a closed position, the first part in the closed position with the stabilizing assembly in its operative state, and the stabilizing assembly, flexible sensor and band are configured so that the flexible sensor, band, and resilient component become captured under pressure between the first part and the base as an incident of the first part being moved from the open position into the closed position.

17. The combination according to claim 16 wherein the stabilizing assembly further comprises a fastener for releasably maintaining the first part in the closed position.

18. The combination according to claim 17 wherein the fastener comprises a threaded fastener with a head with a security fitting configured so that a customized security tool must be utilized to engage and turn the head of the threaded fastener.

19. The security assembly as recited in claim 16.

20. The combination according to claim 15 where the resilient component comprises a compressible foam.

21. The security assembly as recited in claim 1.

22. In combination:

a) a wearable device comprising a band configured to extend at least partially around a limb of a user to maintain the wearable device operatively supported on the user's limb; and b) a security assembly comprising:

a flexible sensor configured to define an electrical circuit path, the flexible sensor secured to the band in an operative state;

a stabilizing assembly that is configured to bear a part of the flexible sensor against the wearable device with the stabilizing assembly in an operative state; and a connecting assembly, a monitoring assembly, and an alarm signal generator, the connecting assembly electrically connecting between the flexible sensor and monitoring assembly, the flexible sensor, connecting assembly, monitoring assembly, and alarm signal generator configured and electrically interconnected to cause the alarm signal generator to generate an alarm signal as an incident of at least one of: a) the flexible sensor being changed from its operative state; and b) the electrical circuit path being altered.

23. In combination:

a) a wearable device comprising a band configured to extend at least partially around a limb of a user to maintain the wearable device operatively supported on the user's limb; and b) a security assembly comprising:

a flexible sensor configured to define an electrical circuit path, the flexible sensor secured to the band in an operative state; and a stabilizing assembly that is configured to resiliently bear a part of the flexible sensor against the wearable device with the stabilizing assembly in an operative state, wherein the wearable device comprises a watch with a case for operating components connected to the band.

24. In combination:

a) a wearable device comprising a band configured to extend at least partially around a limb of a user to maintain the wearable device operatively supported on the user's limb; and b) a security assembly comprising:

a flexible sensor configured to define an electrical circuit path, the flexible sensor secured to the band in an operative state; and a stabilizing assembly that is configured to bear a part of the flexible sensor against the wearable device with the stabilizing assembly in an operative state, wherein the band has an inside surface configured to bear against a user's limb with the wearable device operatively supported on a user's limb and the flexible sensor in its operative state is secured against the inside band surface, wherein with the stabilizing assembly in its operative state the stabilizing assembly bears a part of the flexible sensor against the inside band surface, wherein the stabilizing assembly comprises first and second relatively movable parts and a part of each of the flexible sensor and band resides between the first and second parts of the stabilizing assembly with the stabilizing assembly in its operative state, wherein the first and second parts are connected at a hinge which guides relative movement between the first and second parts around an axis.

* * * * *